United States Patent [19]

Streeter

[11] 4,430,747

[45] Feb. 7, 1984

[54] RECEIVING APPARATUS FOR STEREOPHONIC BROADCAST HAVING AMPLITUDE AND ANGLE MODULATED SIGNAL COMPONENTS

[75] Inventor: Robert D. Streeter, Fort Wayne, Ind.

[73] Assignee: Magnavox Consumer Electronics Company, New York, N.Y.

[21] Appl. No.: 287,037

[22] Filed: Jul. 27, 1981

[51] Int. Cl.[3] ..... H04H 5/00

[52] U.S. Cl. ..... 381/15; 329/135

[58] Field of Search ..... 179/1 GD, 1 GN, 1 GS; 329/130, 135, 139, 147, 167; 455/154, 212, 222, 223, 296, 297; 381/15, 16

[56] References Cited

U.S. PATENT DOCUMENTS 3,999,132 12/1976 Smith ..... 455/212 X 4,232,189 11/1980 Leitch ..... 179/1 GS 4,324,952 4/1982 Smiley ..... 179/1 GS 4,340,782 7/1982 Weigand et al. ..... 179/1 GS

*Primary Examiner*—A. D. Pellinen

*Attorney, Agent, or Firm*—Pollock, Vande Sande & Priddy

[57] ABSTRACT

A receiver for demodulating a stereophonic broadcast signal. Envelope detection is provided for a preselected radio frequency broadcast signal. Angle demodulation of a difference signal contained in the broadcast signal is provided at the radio frequency level avoiding the use of superheterodyne techniques. Improved linearity is achieved over detection techniques which operate at an intermediate frequency level. Receiver protection from excessive negative modulation peaks is provided as well as subsequent audio signal processing.

9 Claims, 1 Drawing Figure

RECEIVING APPARATUS FOR STEREOPHONIC BROADCAST HAVING AMPLITUDE AND ANGLE MODULATED SIGNAL COMPONENTS

BACKGROUND OF INVENTION

The present invention relates to low frequency AM stereophonic broadcasting systems. Specifically, a receiving apparatus for demodulating a stereophonic broadcast including both amplitude modulated components, and angle modulated components is described.

Interest in providing stereophonic broadcast service to the low frequency radio spectrum presently used to broadcast monophonic information has recently developed. The Federal Communications Commission has opened a docket, FCC Docket No. 21313, "In The Matter of AM Stereophonic Broadcasting" for the purpose of evaluating numerous AM stereophonic broadcasting systems for use in the low frequency radio broadcast band.

One such system under consideration by the Federal Communications Commission includes a proposal by the Magnavox Consumer Electronics Company, wherein a system of stereophonic broadcasting is proposed for the low frequency broadcast spectrum. Left, L(T) and Right, R(T) stereophonically related signals are generated in a broadcast studio, and combined to generate a summation signal consisting of L(T)+R(T). The summation signal is used to amplitude modulate the radio frequency signal to provide a full carrier, double side band amplitude modulated signal which is received and demodulated by conventional monophonic AM receivers. Additionally, the system provides for linearly phase modulating the broadcast signal carrier with a difference signal consisting of L(T)−R(T). Further, the Magnavox proposal calls for modulating the carrier frequency with a low frequency identification signal at a modulating index different from the linear phase modulation index.

In U.S. Pat. No. 4,302,626, a type of superheterodyne receiver is described for demodulating such a signal. The use of superheterodyne techniques however has some disadvantages in that preselection circuitry of the receiver must be frequency tuned in synchronization with the tuning of the local oscillator. Certain design problems are encountered, known to those skilled in the art, when precise tracking between the preselection circuitry and the local oscillator signal frequency is required. In stereophonic receivers, mistuning between the local oscillator and preselection circuitry can cause distortion to one or the other sideband sets which are located on each side of the carrier signal. Distortion of the carrier signal sidebands degrades receiver performance.

Additionally, phase detection of the angle modulated components at the intermediate frequency level in the superheterodyne receiver is accomplished in the aforesaid referenced patent by limiting the intermediate frequency signal, and then detecting the phase of the intermediate frequency signal. As is known to those skilled in the art, many phase detectors detect at the time the excursion of the amplitude limited signal level instantaneously crosses through a zero amplitude level. Time differences between the zero crossings are used to derive phase information.

When automobile radios are used, typically, the intermediate frequency signal is at 260 kHz and the number of samples used, i.e., the number of zero crossings, determines the amount of filtering required in deriving the phase information. The recovered phase information necessary includes a minor amount of intermediate frequency signal as a distortion product. Those skilled in the art will recognize that higher intermediate frequencies are easier to filter and requires fewer poles of filtering than lower frequency signals to obtain the same information to distortion product level. Thus, it has occurred to the inventor that detection of phase changes at the radio frequency rate, rather than at a lower intermediate frequency rate, will prove beneficial in providing increased sampling of the phase modulation improving the quality of the recovered difference signal.

SUMMARY OF THE INVENTION

It is an object of this invention to provide for demodulation of broadcast signals containing stereophonic information.

It is a more specific object of this invention to provide for angle demodulation of a broadcast signal with improved performance.

These and other objects of the invention are provided in a receiver wherein the selectively of the receiver is determined by radio frequency preselection circuitry. The receiver avoids the difficulties associated with frequency down conversion, eliminating tracking between radio frequency preselection circuitry and the local oscillator, processing the received radio frequency signal at the same frequency it is received. With the present invention, amplitude modulated signal components are removed, along with angle modulation components at the radio frequency level.

In one embodiment of the invention, designed specifically for the Magnavox AM stereophonic proposal, multiple pole preselection is accomplished at the radio frequency signal level for a broadcast signal. The preselected signal is applied to a phase detector wherein the stereophonic identification signal as well as the aforesaid difference signal are separated from the received broadcast signal. The summation signal is recovered from the received radio frequency signal by an amplitude detector. The recovered summation signal is supplied to a matrix means wherein it is combined with the derived difference signal to provide first and second stereophonic related signals. The matrix means is under control of the detected stereophonic indicating tone whereby in the absence of the detection of said tone, the matrix means provides the summation signal in place of the pair of stereophonic related signals.

In an improved embodiment of the invention, protection of the receiver for amplitude modulation levels which approach one hundred percent is included, thereby avoiding noise generated when a temporary loss of carrier signal is experienced during angle demodulation as a result of negative amplitude modulation levels. Phase detectors when driven by a limiter are known to produce noise bursts when the input signal goes to a marginal level. Negative amplitude modulation peaks during 100% modulating conditions, produce zero level input signals which can produce these objectional noise bursts. The receiver when protected detects the occurrence of these noise bursts and actuates circuitry to eliminate the noise bursts from the audio output. This embodiment also contemplates the optional use of audio processing, wherein filters may be inserted in the input or output of the matrix means for limiting the audio pass band under conditions of weak signal reception such as nighttime sky wave reception. Such filtering enhances the listening quality of these weak signals.

DESCRIPTION OF THE PREFERRED EMBODIMENT

Figure 1:
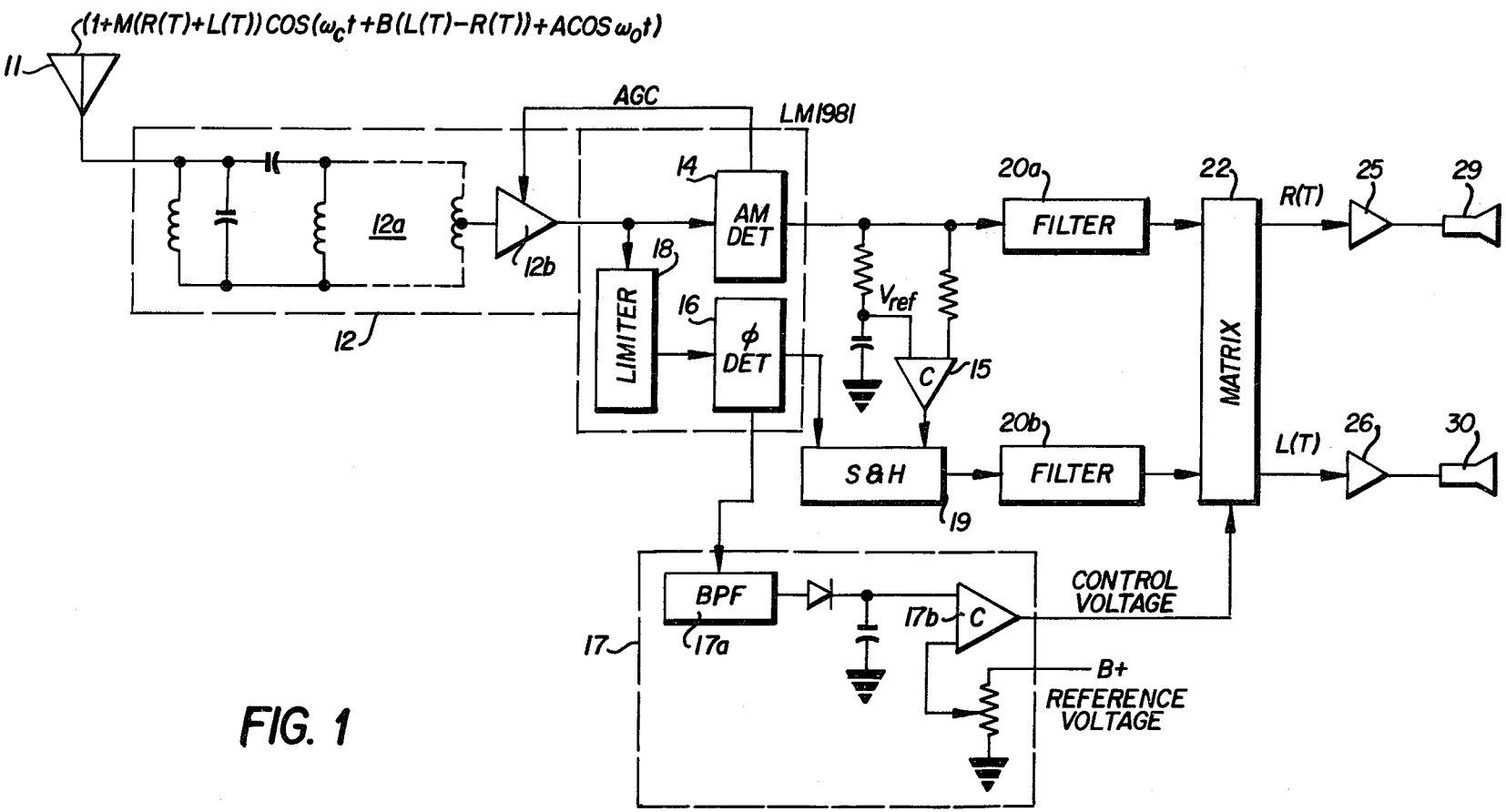
FIG. 1 is a block diagram describing a preferred embodiment of the present invention.

Referring now to FIG. 1, there is shown a block diagram of a receiving apparatus in accordance with the present invention. Antenna 11 collects the broadcast signals and applies them to a preselection and amplification circuit 12. The receiver of FIG. 1 does not use a intermediate frequency stage, and therefore much of the receiver selectivity resides in the preselection circuit 12. In order to provide for quality reception of low frequency amplitude modulated broadcasts, the preselection circuitry 12 should have at least four poles of preselection, with a slight coupling between poles to provide an overall rectangular bandpass when tuned. Those skilled in the art will recognize that quality receivers for consumer use generally include four poles of selectivity, the selectivity being shared between the intermediate frequency signal processing circuitry and the radio frequency preselection circuitry. Those skilled in the art will recognize that a standard loopstick antenna normally adds preselection to an AM radio receiver particularly at the low end of the frequency spectrum. As a preselection circuit, four tuned circuits having the selectivity of a common AM radio loopstick antenna may be gang-tuned with ganged capacitors or matched varactors. Amplifier **12*b*** is a AGC controlled amplifier for providing sufficient signal level for subsequent demodulation.

Amplitude detector 14 is an envelope detector capable of providing a signal proportional to the amplitude modulation components of the broadcast signal. The summation signal, L(T)+R(T), is derived by a detector having a sufficient response time to permit recovery of the highest frequency audio signal of interest. The amplitude detector also provides for a control voltage at a slower response time to accomplish the gain control of amplifier **12*b*** in a manner well known to those skilled in the art.

The angle modulation of a received broadcast signal can be derived, when the broadcast signal is of the type described in the aforesaid Magnavox proposal, by phase demodulating the broadcast signal without converting the signal into a intermediate frequency signal. Phase detector 16 may be of the type manufactured by National Semiconductor Company, described more particularly in the product literature of National Semiconductor Company as LM1981. The detector supplied by National Semiconductor Company includes a frequency discriminator followed by audio signal deemphasis. It is known to those skilled in the art, that as the deemphasis frequency point approaches zero frequency, the signal demodulated and supplied by the following deemphasis circuit, approaches a linearly phase demodulated signal. Also provided with the aforesaid National Semiconductor component, is an output port for deriving a frequency modulated signal tone used to identify the stereophonic broadcast as proposed in the Magnavox submission to the Federal Communications Commission. The detected signal tone is filtered in a bandpass filter **17*a*, rectified and subsequently applied to a comparator 17*b*. The detection of the presence or absence of the signal tone is accomplished by a comparator 17*b* having a reference input connected to a reference voltage which upon receipt of the rectified signal tone, applies a control voltage to matrix means 22. The aforesaid National Semiconductor component also includes an amplitude detector and limiter circuit as shown in FIG. 1**.

It can be seen that angle demodulating the broadcast signal at the radio frequency signal level provides for more zero crossings of the radio frequency signal for a period of time then occurs at a lower intermediate frequency. As many phase detectors, including the aforementioned National Semiconductor device, detect phase changes by the time difference between zero amplitude crossing of a given signal, the increased number of samples provided by detecting the radio frequency signal improves the performance of a phase recovered signal over those techniques which use superheterodyne procedures for first deriving a lower intermediate frequency signal before angle demodulating. A limiter 18 may also be used ahead of the phase detector to insure that the signal is amplitude normalized before applying it to the angle demodulator.

The output of the phase detector 16 comprises a difference signal L(T)−R(T) which is applied to a sample and hold circuit 19. During reception of broadcast signals which have negative modulation amplitudes less than the peak negative amplitude which occurs at a 95% modulation index, sample and hold circuit 19 is enabled to provide the difference signal to filter **20*b*. When the amplitude level of the received radio frequency signal drops to a level reflecting a modulation index greater than a 95% modulation index, comparator 15 supplies a signal for holding the level of signal applied to matrix 22 at a constant value. The comparator 15, and sample and hold circuit 19, provide for a protected receiver which does not erroneously decode marginal levels of broadcast signals. Protection techniques such as this are described more particularly in U.S. Pat. No. 4,340,782 filed June 13, 1980 by the same inventor and James Weigand and in the aforementioned FCC docket. This protection is accomplished by comparing with comparator 15 the instantaneous amplitude of the derived summation signal with the signal level which represents a negative modulation peak corresponding to an index of approximately 95%. When the amplitude of the summation signal is less than the level represented by the aforesaid negative modulation peak, sample and hold circuit 19** enters the hold mode until the signal level once again attains an appropriate level.

Audio processing is provided with filters **20*a* and 20*b*. This processing may be optional, and those skilled in the art may wish to provide means for switching in and out of the signal path the summation and difference signals filters 20*a*, 20*b*. However, it has been found that limiting the frequency passband for a marginal amplitude signal, such as may be encountered under certain skywave receiving conditions, improves the quality of the received signal. Such filters may comprise a five kHz low pass filter for night time reception. During day time reception a different filter bandwidth such as 15 kHz may be selected. Although the filters 20*a* and 20*b* in FIG. 1 are shown connected to the input side of matrix 22**, it is clear that they may also be on the output side.

A matrix means 22 combines the summation and difference signals to derive stereophonic related signals.

The stereophonic signals individually drive speakers 29 and 30 through amplifiers 25 and 26. The matrix means 22 is also under the control of a stereophonic identification tone. Matrix means 22 is arranged to provide the stereophonic related signals only when the presence of a stereophonic indicating tone has been detected. In the event that the tone is not determined to be present in the broadcast, the matrix means will provide the summation signal, L(T)+R(T) to amplifiers 25 and 26 whereby the speakers 29 and 30 will be driven by the same signal comprising a monophonic signal.

Thus, there has been described with respect to one embodiment a receiver for avoiding superheterodyne techniques, as well as providing for improved demodulation of an angle modulated signal. Although the foregoing embodiment has been described with respect to a linear phase modulated difference signal, it is clear that the teachings of this application, may be modified for use with suitable detection techniques to derive angle modulation components which may be other than linear phase modulation components. Further, the use of the particular National Semiconductor device as a demodulator is considered adequate, but other techniques will suggest themselves for implementation as an angle demodulator to those skilled in the art.

The foregoing is by illustration only of one embodiment of an invention described more particularly by the claims which follow.

I claim:

1. A receiver for demodulating a radio frequency signal which is simultaneously modulated in amplitude by the summation of stereophonic related signals (R(t) and (L(t) and linearly modulated in phase by the difference of said related signals L(t)−R(t), comprising:

a tunable radio frequency filter for selectively tuning said radio frequency signal;

an envelope detector connected to said filter for providing a signal proportional to said summation of stereophonically related signals;

a phase detector for receiving said radio frequency signal from said tunable radio frequency filter, and providing an output signal which is linearly proportional to a phase change in said radio freqency signal, said radio frequency signal providing increased sampling of said linear phase modulation at said radio frequency rate and a reduction in distortion products;

and matrix means for combining said phase detector output signal with said envelope detector signal whereby stereophonic related signals R(t), L(t) are produced by combining a linearly phase detected signal with an amplitude detected signal.

2. A receiver according to claim 1, further comprising:

means for detecting when a received radio signal has an amplitude below a predetermined minimum level; and means for holding an output signal from said phase detector at a substantially constant level when said received radio signal is below said predetermined minimum level.

3. A receiver for demodulating a radio frequency signal which is simultaneously modulated in amplitude with the summation of a pair of stereophonically related signals R(t), L(t), linearly phase modulated at a first modulation index with the difference of said related signals L(t)−R(t), and angle modulated at a second modulation index with an indicator signal comprising:

a tunable radio frequency filter for selectively tuning said radio frequency signal;

an envelope detector connected to said filter for removing an amplitude modulated signal from said radio frequency signal without converting said radio frequency signal to an intermediate frequency signal, whereby an output signal proportional to the summation of said stereophonic signals is produced;

a phase detector connected to said filter for receiving said radio frequency signal phase modulated with said difference signal and modulated with said indicator signal, said detector providing an output signal linearly proportional to phase modulation of said radio frequency signal L(t)−R(t), said radio frequency rate providing increased sampling of said phase modulation, reducing distortion products accompanying said output signal, and providing a signal proportional to said indicator signal;

a threshold detector connected to said phase detector for providing an output signal when said signal proportional to said indicator signal exceeds a predetermined level; and, matrix means having first and second inputs connected to receive said envelope detector output signal and phase detector signal linearly proportional to said radio frequency signal phase, and a third input for receiving an output signal from said threshold detector, said matrix means being enabled to provide first and second stereophonic signals by combining said phase detector outpput signal with said envelope detector output signal when enabled by said threshold detector output signal.

4. The receiver of claim 3, wherein said matrix means supplies a signal proportional to said envelope detector output signal in the absence of an output signal from said threshold detector.

5. The receiver of claim 3, further comprising audio filtering means for modifying the frequency content of signals from said phase detector and said envelope detector.

6. The receiver of claims 1, 3 or 4, wherein said tunable radio frequency filter comprises a multipole filter.

7. The receiver of claim 6, wherein said radio frequency filter has four poles.

8. The receiver of claim 5, wherein said audio filtering means comprises a low pass filter.

9. The receiver of claim 8, wherein said low pass filter has a passband of substantially 5 kHz.

* * * * *